US006095058A

United States Patent [19]

Earnhart

[11] Patent Number: 6,095,058

[45] Date of Patent: Aug. 1, 2000

[54] LAP BEVERAGE/CUP HOLDER WITH WINGS

[76] Inventor: Stephen P. Earnhart, 29 Catamaran St., Marina del Rey, Calif. 90292

[21] Appl. No.: 09/245,415

[22] Filed: Feb. 5, 1999

[51] Int. Cl.[7] ..... A47B 37/00

[52] U.S. Cl. ..... 108/43; 224/275; 2/48

[58] Field of Search ..... 108/42, 43, 44, 108/25; 224/148.1, 148.4, 148.7, 275; 2/49.1, 46, 48, 50, 51; 248/311.2

[56] References Cited

U.S. PATENT DOCUMENTS

| | | | |
|---|---|---|---|
| 2,039,922 | 5/1936 | Neats et al. . | |
| 2,199,334 | 4/1940 | Ferry | 2/50 |
| 2,875,940 | 3/1959 | Dunn | 224/275 |
| 5,005,702 | 4/1991 | Davis et al. . | |
| 5,069,375 | 12/1991 | Flick | 108/44 |
| 5,081,936 | 1/1992 | Drieling . | |
| 5,134,930 | 8/1992 | Mei-Hwa . | |
| 5,181,275 | 1/1993 | Spulgis | 2/48 |
| 5,282,598 | 2/1994 | Greene | 224/563 |
| 5,297,767 | 3/1994 | Miller et al. | 248/311.2 |
| 5,513,576 | 5/1996 | Ward . | |
| 5,520,119 | 5/1996 | Eisenberg . | |
| 5,701,605 | 12/1997 | Bowen | 2/46 |

*Primary Examiner*—Peter M. Cuomo
*Assistant Examiner*—Jerry A. Anderson
*Attorney, Agent, or Firm*—Birch, Stewart, Kolasch & Birch, LLP

[57] ABSTRACT

A lap mat for overlaying a person's lap includes openings for holding a beverage container and food items. A pocket is located under the openings and resides between the person's legs when the lap mat overlays the person's lap. The pocket provides thermal insulation and containment of the beverage and food items inserted into the openings. The lap mat offers a convenient holder for the person to place a beverage or food item while seated, such as when operating or riding in a vehicle. Also, the lap mat protects the person's lap and clothing from spills.

18 Claims, 7 Drawing Sheets

LAP BEVERAGE/CUP HOLDER WITH WINGS

BACKGROUND OF THE INVENTION

1. Field of the Invention

The present invention relates to a mat for overlaying a person's lap. More specifically, the present invention relates to a lap mat for holding a beverage container and other items while protecting a person's lap from crumbs or drips.

2. Description of the Background Art

Due to today's fast paced lifestyle, many people find it necessary, or at least convenient, to consume food and beverages while operating, or riding in, a motor vehicle. Usually, the food or beverage is consumed over some period of time during the operation of the vehicle. To this end, drivers and passengers need a nearby location to temporarily place the food and beverage containers during consumption breaks.

In appreciation of this need, many vehicle manufacturers provide cup holder features and tray features in or about the dash and consoles of the vehicle. These features are usually integrally formed with the dash or console and can be difficult to clean when spilt food and beverages soil them. Further, the remote location of the features often causes a person to divert their attention when attempting to retrieve their food or beverage. This can prove fatal when the user is the driver of the vehicle. Moreover, these features offer no protection to the clothing of the users from soiling when food or beverages are spilt.

To this end, it has been proposed to place a tray in the lap of the vehicle operator for holding a beverage container and food. U.S. Pat. No. 5,069,375, issued to Flick, discloses a rigid food support tray. The rigid food support tray is placed over the lap of the vehicle operator. By the close proximity, the operator need not divert his eyes from the road when retrieving his food or beverage. Further, the tray will protect the vehicle operator's lap from a spilt beverage and dropped food. U.S. Pat. Nos. 5,520,119; 5,081,936; and 2,039,922 also disclose rigid food support trays similar to the rigid tray of Flick.

A rigid support tray suffers several disadvantages. First, a rigid tray consumes a large amount of space during storage. Space in the cabin area of a vehicle is extremely limited, and it is inconvenient to retrieve a rigid tray from the trunk space of the vehicle each time the tray is needed. Second, the rigid tray is troublesome to clean. Because of its size, it usually will not fit into an automatic dishwasher, and therefore must be washed by hand. Third, rigid materials are generally uncomfortable to the user. The tray's rigid form provides an awkward fit to the user's lap, and could hinder movements of the user if it abuts surrounding objects, such as the steering wheel. Fourth, in the unfortunate event of a vehicular accident, the rigid tray could cut, bruise and injury the user.

U.S. Pat. No. 5,134,930, issued to Mei-Hwa, discloses an inflatable tray. The inflatable tray is placed over the lap of the user and used during the consumption of food and beverages. The inflatable tray will protect the user's lap from a spilt beverage or food item. Also, the inflatable portions of the tray will be less dangerous to the user should a vehicular accident occur. U.S. Pat. No. 5,005,702 also discloses an inflatable food support tray similar to the inflatable tray of Mei-Hwa.

The inflatable tray suffers several disadvantages. First, the tray, in its inflated state, will occupy a large space in the vehicle, both when in use and when being stored. Second, if the tray is deflated for compact storage, it will be inconvenient to inflate the tray every time the user wishes to consume a food or beverage. Third, the inflatable tray is troublesome to clean. Because of its plastic material and susceptibility to rupturing, it would appear to be not well-suited for automatic dishwashers or clothes washers, and therefore must be washed by hand. Fourth, the inflatable dimensions of the tray could prove troublesome to some users because the tray will not conform to the contours of the user. Also, the height of the inflatable tray could interfere with the steering wheel when used by the operator of the vehicle.

U.S. Pat. No. 5,513,576, issued to Ward, discloses a lap table constructed of polyethylene material. The lap table has a natural tendency to coil up. Further, a hole is provided in the lap table so that a beverage container can be partially inserted through the hole and reside between the user's legs.

This coiled lap table with a beverage container hole has several disadvantages. First, the pants or legs of the user will be directly exposed to the beverage container. This can be uncomfortable when drinking a hot or cold beverage. Second, if condensation forms on the beverage container, or drips of the beverage are present on the sides of the beverage container, the user's pants or legs will be soiled. Third, the lap table will assume the shape of a coil when removed from the user's lap. This coil will have a fixed length, which may prove troublesome when storing or cleaning the lap table.

SUMMARY OF THE INVENTION

It is a primary object of the present invention to provide a food and beverage holder which overcomes the shortcomings of the prior art devices.

One object of the present invention is to provide a flexible lap mat which can be collapsed into an irregular shape for easy storage in a small space when not in use.

Another object of the present invention is to provide a flexible lap mat which can be easily cleaned.

Yet another object of the present invention is to provide a flexible lap mat which will comfortably fit the contours of the user's lap and legs and not hinder movements of the user.

These and other objects of the present invention are fulfilled by providing a lap mat for overlaying a person's lap and for holding foods or beverages, said lap mat comprising: a flexible sheet of material having a first surface and a second surface; a cutout formed in an approximately central region of said flexible piece of material, said cutout passing from said first surface through to said second surface; and a pocket attached to said second surface, said pocket surrounding at least a portion of said cutout beneath said second surface, said pocket for residing between the legs of a person when said lap mat overlays the person's lap.

Moreover, these and other objects of the present invention are fulfilled by providing a lap mat for overlaying a person's lap and for holding foods or beverages, said lap mat comprising: a flexible sheet of material having a first surface and a second surface; a cutout formed in an approximately central region of said flexible piece of material, said cutout passing from said first surface through to said second surface; a cover attached to said flexible sheet and covering said cutout, said cover having a first circular opening for receiving a beverage container; and a pocket attached to said second surface, said pocket completely surrounding said cutout beneath said second surface, said pocket for residing between the legs of a person when said lap mat overlays the person's lap.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
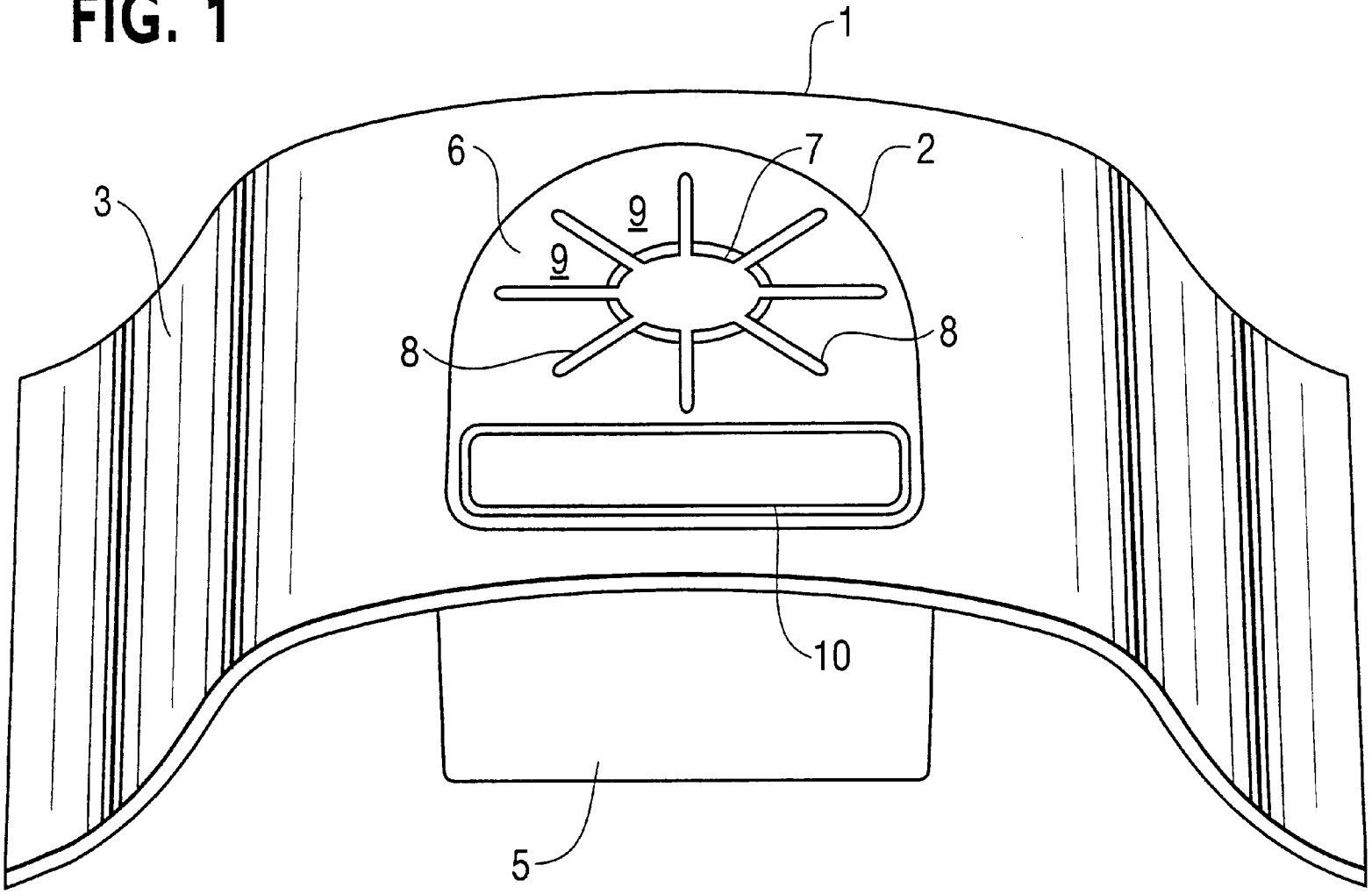
FIG. 1 is a top perspective view illustrating a lap mat in accordance with the present invention.
Figure 2:
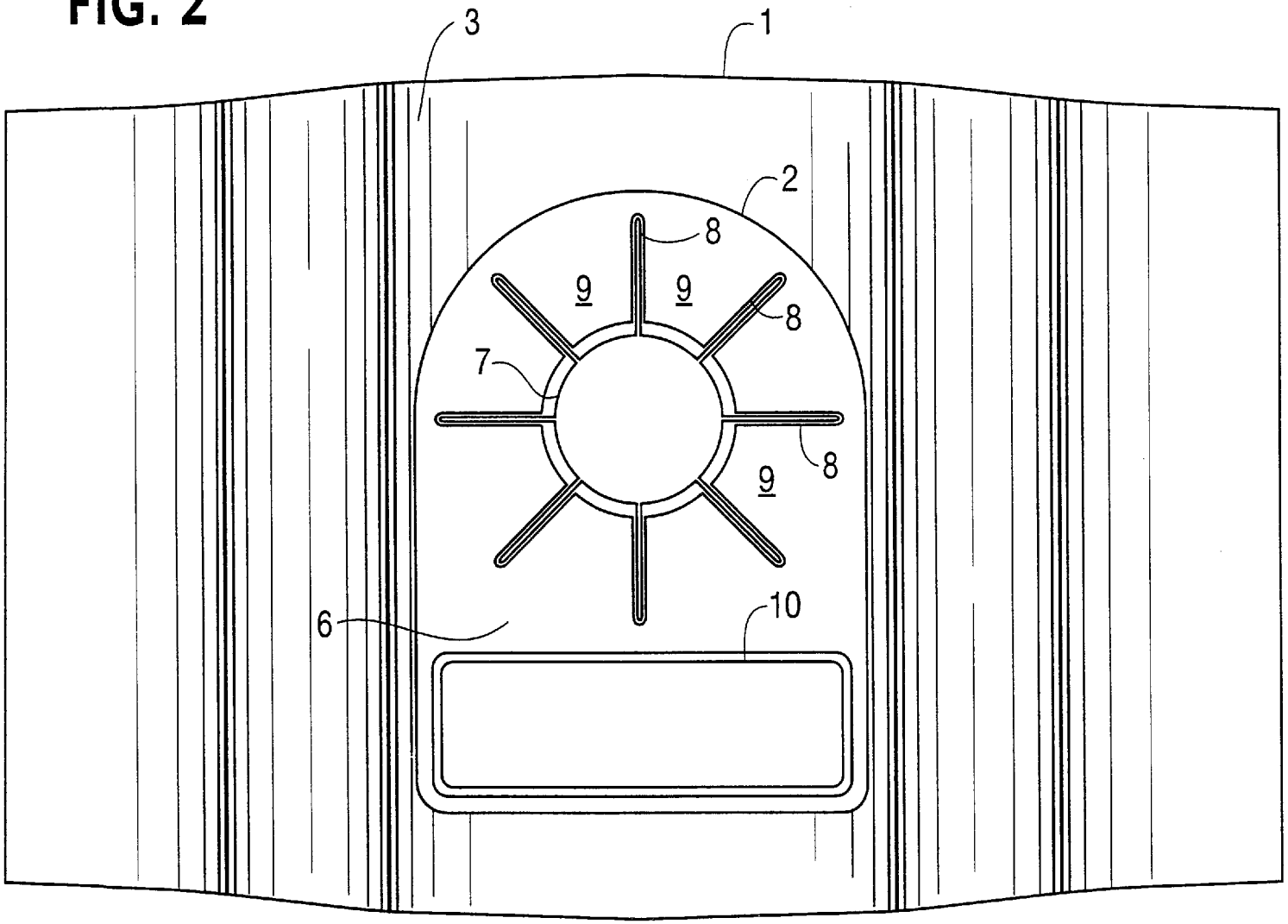
FIG. 2 is a top view of the lap mat of FIG. 1.
Figure 3:
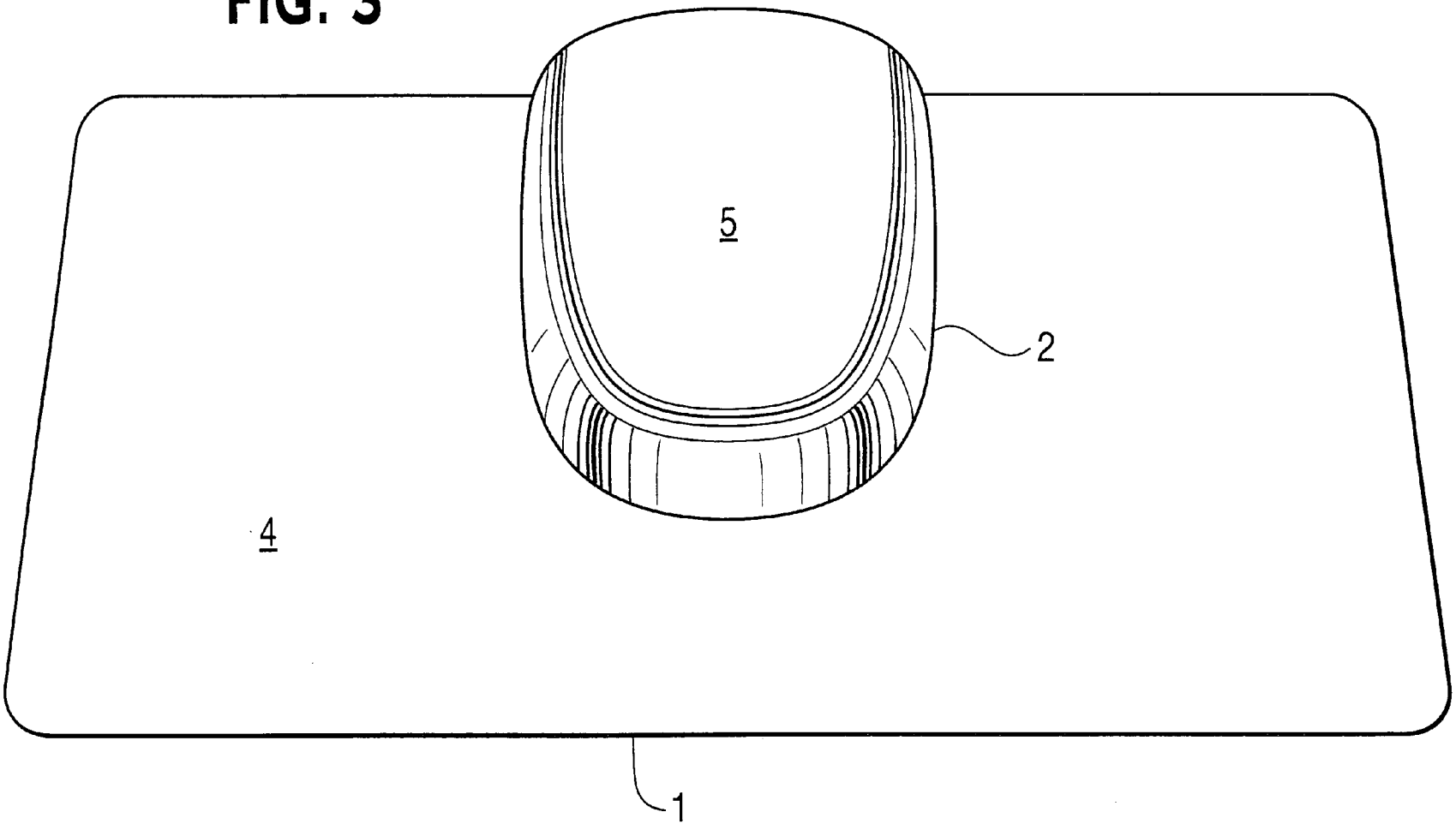
FIG. 3 is bottom perspective view of the lap mat.

Referring in detail to the drawings and with particular reference to FIGS. 1–3, a lap mat, in accordance with the present invention, includes a generally flat flexible sheet 1. The sheet 1 has a rectangular perimeter and is formed of a resilient, flexible, foam material. The material used to form the sheet is preferably neoprene, although it is envisioned that other flexible materials could be substituted.

A cutout portion 2 is formed in a central region of the sheet 1. The cutout portion 2 passes from an upper surface 3 of the sheet 1 through to a lower surface 4. The cutout portion 2 may be formed by removing a piece of the sheet 1, or alternatively, the sheet 1 could be originally formed with the cutout portion 2.

A pocket 5 is attached to the lower surface 4, by stitching or adhesive. Of course, other known attachment techniques or integral forming techniques could be used. The pocket 5 completely surrounds the cutout portion 2. The pocket 5 is also formed of a resilient foam material, such as neoprene.

A cover 6 is attached to the sheet 1 and completely covers the cutout portion 2. The cover 6 may also be attached by a stitching or adhesive process, or by an integral forming process. The cover 6 may be formed of neoprene, however it is more preferably formed of a dissimilar material having slightly more rigidity than the sheet 1, such as a resilient plastic.

A first opening 7 is formed in the cover 6. The first opening 7 has a circular perimeter and opens into an interior of the pocket 5. A plurality of slits 8 extend within the cover 6 and connect to the first opening 7. The slits 8 are through and define tabs 9. The tabs 9 are resilient and can be bent downwardly into the interior of the pocket 5. Due to the resiliency of the tabs 9, the tabs 9 provide some level of resistance to this bending, and try to assume an unbent state co-planar with the cover 6. A second opening 10 is also formed in the cover 6. The second opening 10 has a rectangular perimeter and opens into the interior of the pocket 5.

Figure 4:
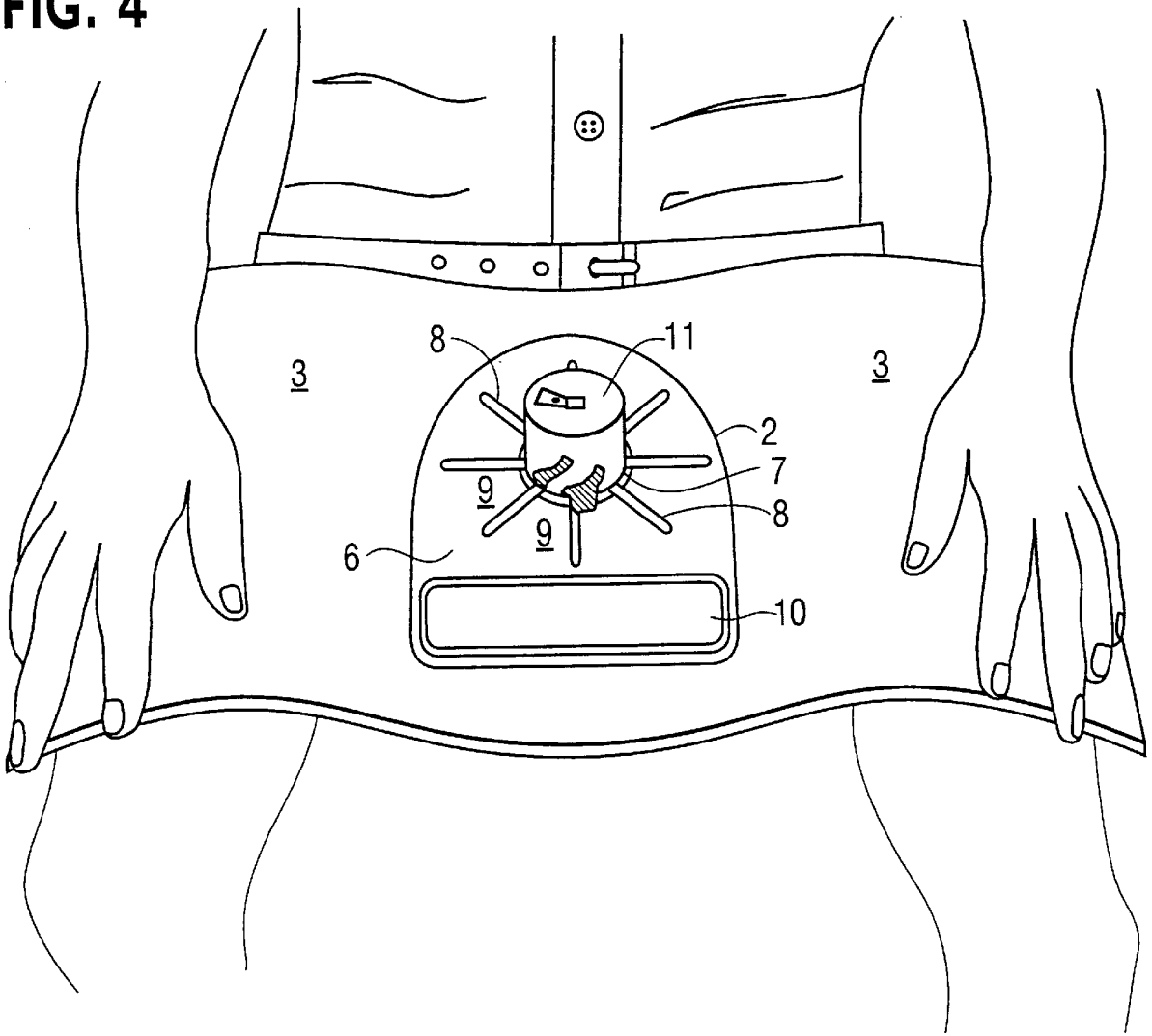
FIG. 4 is top perspective view of the lap mat in a user's lap.

Now, with reference to FIG. 4, the operation of the lap mat will be described. A person in a seated position spreads his legs slightly apart. The legs of the person straddle the pocket 5 and the edges of the sheet 1 extend over the legs of the person. A beverage container 11 can be placed into the first opening 7. The tabs 9 will hold the beverage container 11 in an upright position. Due to the resiliency of the tabs 9, a beverage container 11 of an increased diameter, such as a super sized container, may be inserted into the first opening 7 and maintained in an upright position. The second opening 10 can be used to hold a package of French fries, napkins, a sandwich, a taco, a map, etc.

By the above arrangement, the seated person can easily located their food and beverage items. Because of the close proximity of the food and beverage to the lap of the person, the person need not divert their attention way from their activities, such as driving, when reaching for and replacing food and beverage items. Also, the flexible material of the sheet 1 will provide a comfortable forming fit to the person's legs and lap. The flexibility of the lap mat will not hinder the movements of the person, and the foam material of the pocket 5 will insulate the temperatures of the beverage and foods from the person's legs. Also, the lap mat will provide a comforting warmth, as a blanket would, during the colder seasons. Should an accident occur, the flexible material used in the construction of the lap mat will compress, reducing the likelihood of harm to the person, and could possibly providing additional cushioning against the steering wheel, dash and other vehicle components.

The sheet 1 will catch any inadvertently dropped food or spilt beverage and will protect the clothing and skin of the person's legs and lap from stains or burns. To clean the lap mat, the person need only wipe up the spills with a napkin, since the neoprene material will resist fluid absorption. Alternatively, one could simply toss the lap mat into a clothes washing machine. For compact storage, the lap mat can be folded into an irregular shape or rolled up. In the compact state, the lap mat should easily fit beside or underneath the seat of a vehicle, in a glove box, or in an armrest console.

Figure 5:
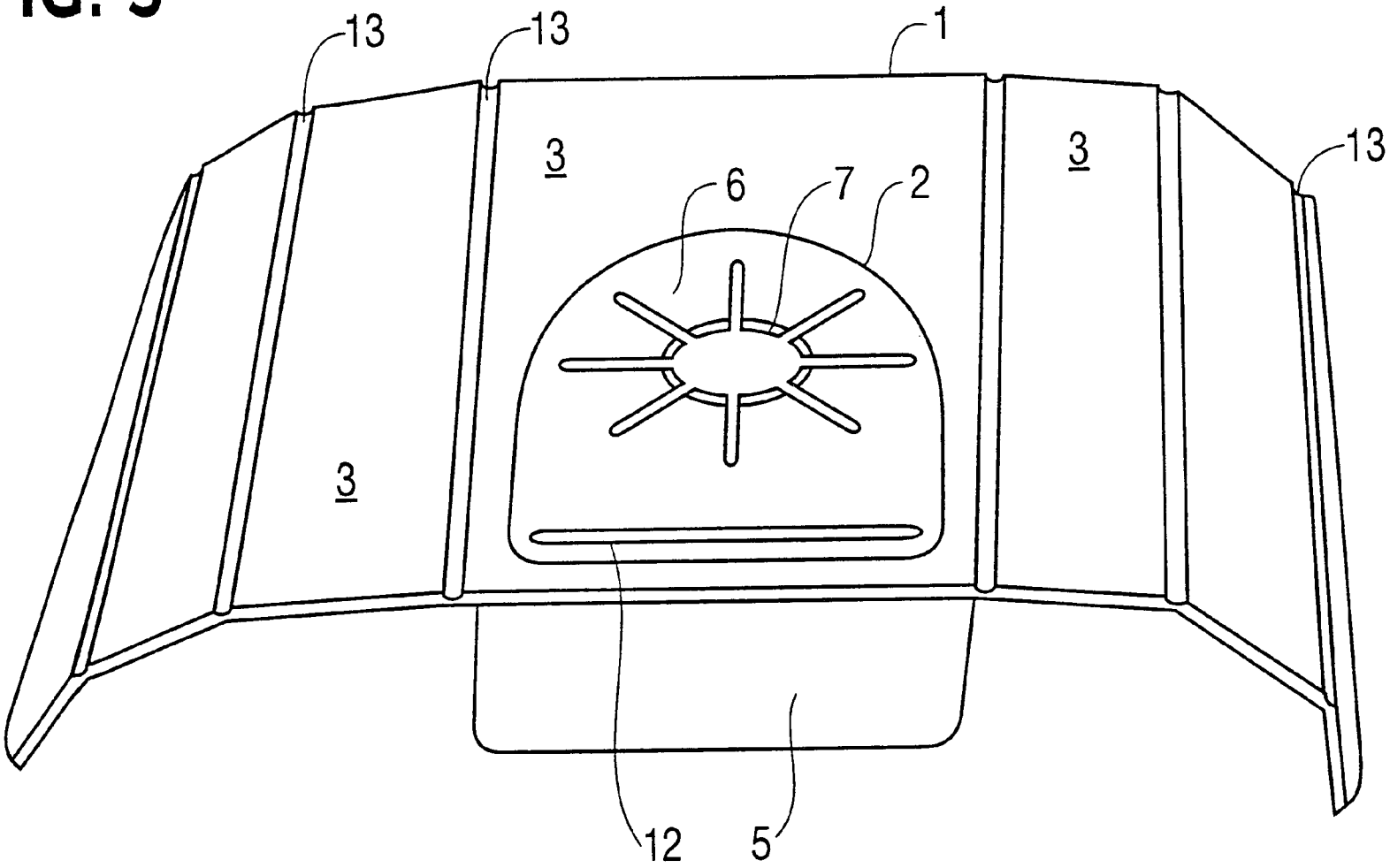
FIG. 5 is a top perspective view illustrating a lap mat in accordance with a second embodiment of the present invention.

FIG. 5 illustrates a second embodiment of the lap mat. Similar elements have been labeled with the same reference numerals used above. In the second embodiment, the perimeter of the second opening 10 has been modified to resemble a narrow slit 12. The narrow slit 12 would be better suited for holding thin items, such as napkins and maps. Also, the sheet 1 has been modified to include ribs 13 of a reduced material thickness. The ribs 13 would assist in the bending of the sheet 1 so that the sheet 1 conforms to the contours of the user's lap. Further, the ribs 13 would allow the sheet 1 to be constructed of a relatively more rigid material. It is also envisioned that the sheet 1 could be formed of separate pieces of material which would be connected to each other at the ribs 13.

Figure 6:
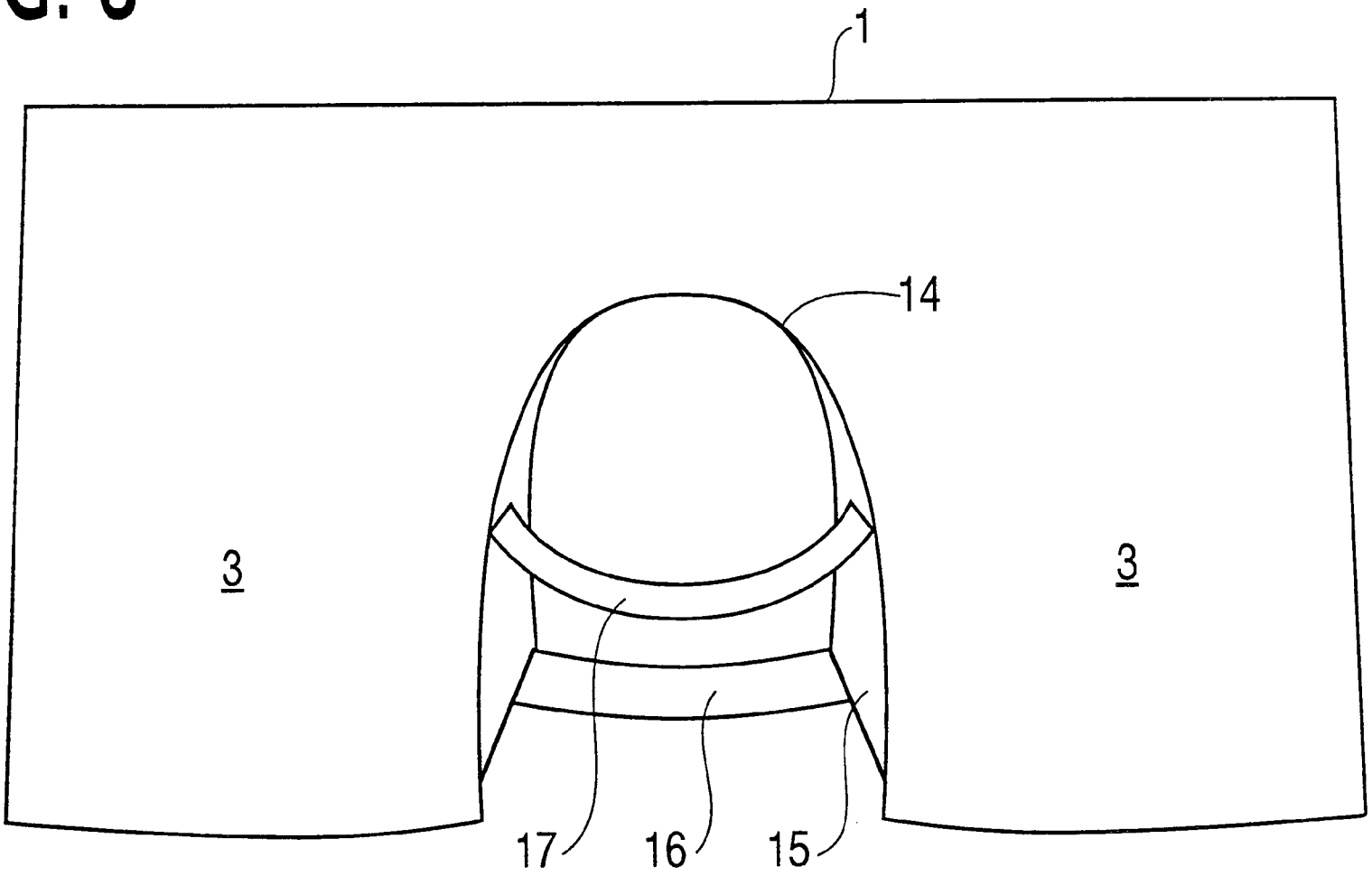
FIG. 6 is top view illustrating a lap mat in accordance with a third embodiment of the present invention.
Figure 7:
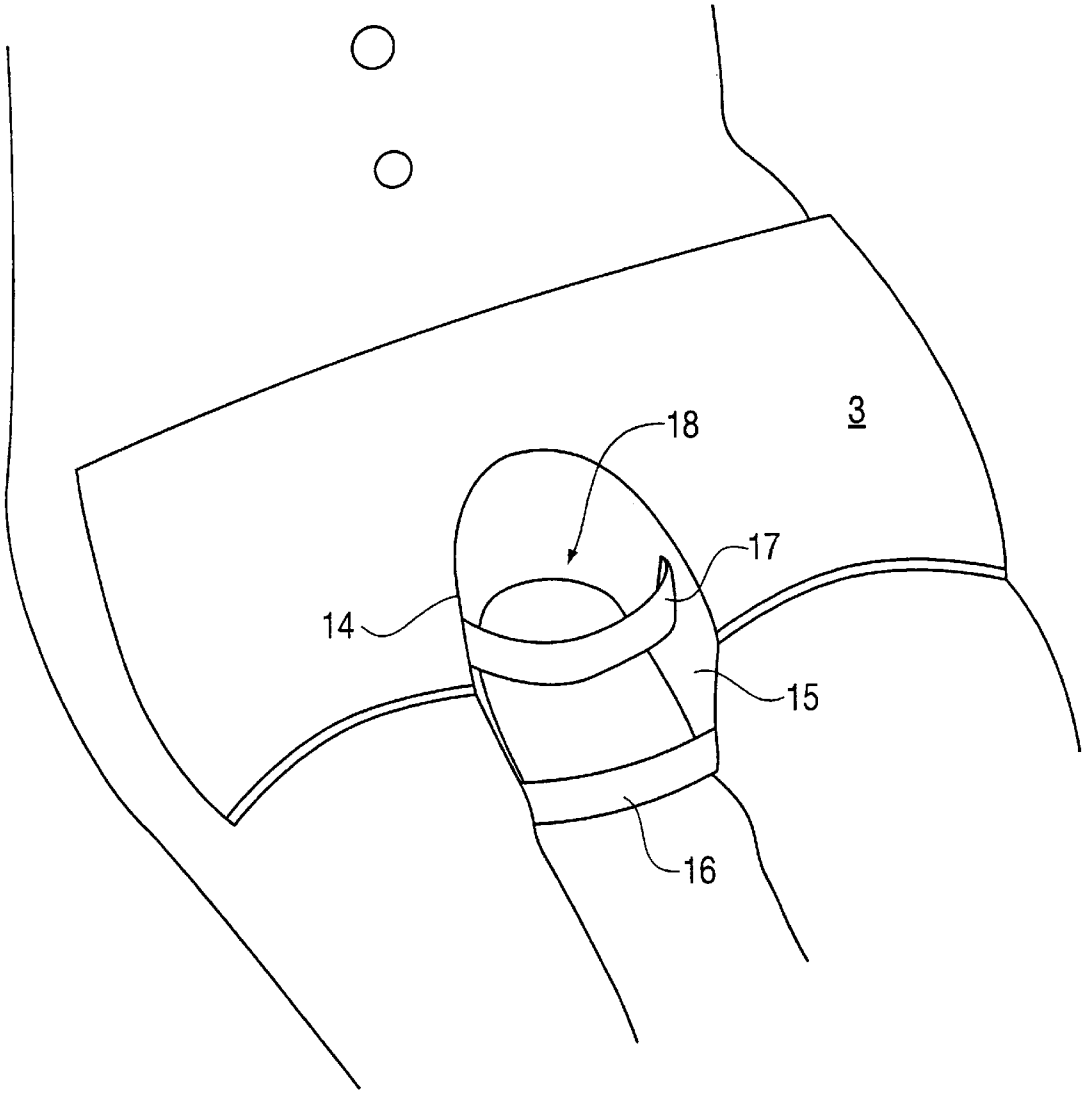
FIG. 7 is a top perspective view illustrating the lap mat of the third embodiment in a user's lap.

FIGS. 6 and 7 illustrate a third embodiment of the lap mat. In the third embodiment, the perimeter of a modified cutout portion 14 has been extended to exceed the boundaries of the sheet 1. No cover 6 or first or second opening 7, 10 are provided. A modified pocket 15 partially surrounds the new cutout portion 14, a portion of the modified pocket 15 includes a lip 16, which extends upwards toward the bottom surface 4 of the sheet 1.

An elastic strap 17 is provided inside the modified pocket 15. The ends of the elastic strap 17 are attached to the interior of the modified pocket 15 to define a beverage containment area 18. When a beverage container is inserted into the beverage containment area 18, the elastic strap 17 expands to accommodate the size of the container. Therefore, larger beverage containers, such as super sized containers, can be accommodated. The lip 16 would prevent any dripped beverage or condensation from leaving the modified pocket 15 and soiling the seat, clothing, or legs of the user.

Although the lap mat has been described in a vehicular environment, it should be appreciated that the lap mat would be beneficial in other environments, such as at picnics, sporting events, or while watching television. Further, it is envisioned that the upper surface 3 of the sheet 1 could be imprinted with indicia, such as logos, advertisements, conversion tables, pictures or other graphics.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lap mat for overlaying a person's lap and for holding foods or beverages, said lap mat comprising:

a flexible sheet of material having a first surface and a second surface;

a cutout formed in an approximately central region of said flexible piece of material, said cutout passing from said first surface through to said second surface; and a pocket attached to said second surface, said pocket surrounding at least a portion of said cutout beneath said second surface, said pocket for residing between the legs of a person when said lap mat overlays the person's lap.

2. The lap mat according to claim 1, wherein said flexible sheet is constructed of a foam material.

3. The lap mat according to claim 2, wherein said foam material is neoprene.

4. The lap mat according to claim 1, further comprising:

an elastic strap having two ends attached to inside surfaces of said pocket for frictionally engaging a lower portion of a beverage container.

5. The lap mat according to claim 1, further comprising:

a cover attached to said flexible sheet and covering said cutout, said cover having a first circular opening for receiving a beverage container.

6. The lap mat according to claim 5, further comprising:

a plurality of slits extending away from said first opening for allowing said first opening to accept a beverage container of an increased diameter.

7. The lap mat according to claim 5, further comprising:

a second rectangular opening formed in said cover.

8. The lap mat according to claim 5, further comprising:

a plurality of reduced-thickness ribs formed in said flexible sheet to define relatively more flexible locations in said flexible sheet.

9. The lap mat according to claim 1, wherein said flexible sheet is a one-piece integral sheet having an outer perimeter in the shape of a rectangle.

10. A lap mat for overlaying a person's lap and for holding foods or beverages, said lap mat comprising:

a flexible sheet of material having a first surface and a second surface;

a cutout formed in an approximately central region of said flexible piece of material, said cutout passing from said first surface through to said second surface;

a cover attached to said flexible sheet and covering said cutout, said cover having a first circular opening for receiving a beverage container; and a pocket attached to said second surface, said pocket completely surrounding said cutout beneath said second surface, said pocket for residing between the legs of a person when said lap mat overlays the person's lap.

11. The lap mat according to claim 10, wherein said flexible sheet is constructed of a foam material.

12. The lap mat according to claim 10, wherein said pocket is constructed of a foam material.

13. The lap mat according to claim 10, wherein said flexible sheet and said pocket are constructed of neoprene.

14. The lap mat according to claim 10, further comprising:

a plurality of slits extending away from said first opening for allowing said first opening to accept a beverage container of an increased diameter.

15. The lap mat according to claim 10, further comprising:

a second rectangular opening formed in said cover.

16. The lap mat according to claim 10, further comprising:

a plurality of reduced-thickness ribs formed in said flexible sheet to define relatively more flexible locations in said flexible sheet.

17. The lap mat according to claim 10, wherein said flexible sheet is a one-piece integral sheet having an outer perimeter in the shape of a rectangle.

18. The lap mat according to claim 17, wherein said flexible sheet and said pocket are constructed of neoprene.

* * * * *